US005305561A

United States Patent [19]

Goddard

[11] Patent Number: 5,305,561

[45] Date of Patent: Apr. 26, 1994

[54] INFLATABLE HOUSING STRUCTURE

[76] Inventor: David L. Goddard, BP24, 83440 Callian, France

[21] Appl. No.: 828,992

[22] PCT Filed: Jul. 24, 1990

[86] PCT No.: PCT/GB90/01138

§ 371 Date: Feb. 24, 1992

§ 102(e) Date: Feb. 24, 1992

[87] PCT Pub. No.: WO91/01250

PCT Pub. Date: Feb. 7, 1991

[30] Foreign Application Priority Data

Jul. 25, 1989 [GB] United Kingdom ..... 8916988

[51] Int. Cl.[5] ..... E04H 15/20

[52] U.S. Cl. ..... 52/2.22; 52/2.21; 52/2.18; 114/121; 114/125

[58] Field of Search ..... 52/2.11, 2.18, 2.21, 52/2.25, 2.26, 2.13, 2.22, 2.24, 745.2; 114/361, 125, 121, 123, 44

[56] References Cited

U.S. PATENT DOCUMENTS

| | | | |
|---|---|---|---|
| 3,137,307 | 6/1964 | Scurlock . | |
| 3,448,712 | 6/1969 | Lehmann et al. | 114/44 |
| 3,800,735 | 4/1974 | Simpson | 52/2.21 |
| 4,004,380 | 1/1977 | Kwake | 52/2.24 |
| 4,047,390 | 9/1977 | Boyce, II | 52/2.21 |

FOREIGN PATENT DOCUMENTS

| | | | |
|---|---|---|---|
| 1182375 | 2/1985 | Canada . | |
| 0201012 | 11/1986 | European Pat. Off. | 52/2.18 |
| 0345600 | 12/1989 | European Pat. Off. | 52/2.18 |
| 0919136 | 10/1954 | Fed. Rep. of Germany . | |
| 2319314 | 2/1977 | France . | |
| 8702438 | 4/1987 | PCT Int'l Appl. | 52/2.18 |
| 0566745 | 9/1975 | Switzerland | 52/2.24 |

*Primary Examiner*—Carl D. Friedman
*Assistant Examiner*—Winnie Yip
*Attorney, Agent, or Firm*—Litman, McMahon & Brown

[57] ABSTRACT

A floating inflatable structure is used to house a vessel for repair while it is afloat. The structure has inflatable walls containing water ballast. The height of the structure above the water can be adjusted by either introducing or expelling water ballast from the foot of the walls. Alternatively, a separate water ballast tube may be provided, the height of which can be adjusted relative to the structure.

3 Claims, 3 Drawing Sheets

INFLATABLE HOUSING STRUCTURE

The present invention relates to an inflatable housing structure, and more particularly to an inflatable building which can be used on water to house a boat or other vessel.

Inflatable tubular buildings, with a framework of circular section tubes forming an arch of semi-circular Gothic form, have been known for many decades. These buildings have a high inherent strength due to the bending stiffness of the tubes and the shear stiffness of the joints between the tubes. The inherent mechanical strength of the inflatable tubes is due to pre-tension in the fabric skin caused by internal pressure. The level of pre-tension is selected in dependence on factors such as windage, the self-weight of the building, and the weight of any add-on items. In all cases it has to be ensured that the safety margin of the fabric strength due to internal pressure plus maximum positive bending stresses is not exceeded; furthermore, the fabric pre-tension under maximum bending stresses must not be reduced to zero.

The strength of the building also depends on its anchorage being of a strength which provides sufficient reaction to all applied horizontal and vertical loads. For land-based buildings, ground reactions are provided by means of fixtures such as pegs, stakes and guy ropes; in addition, the ground obviously provides a reaction to the weight of the building.

Existing structures, however, are unsuitable for use on water since they would be unstable. The present invention seeks to overcome this problem. The present invention also seeks to provide a structure of which the height in the water can be adjusted.

U.S. Pat. No. 4,004,380 discloses an air supported double wall structure for use on the ground and having water ballasts 30, 120. In view of its construction, however, the structure would immediately collapse if placed on water.

U.S. Pat. No. 3,137,307 discloses an air supported frame, one end of which is arranged to be supported by water. Canadian Patent 1182375 discloses a housing for use on land having walls comprising inflatable ribs and water as a ballast medium.

According to the first aspect of the present invention there is provided a method of housing a floating vessel characterised in that it comprises placing the vessel in a floating structure which has inflatable walls, water-ballast receiving means at or adjacent the foot of at least one of the walls, and adjustment means also at or adjacent the foot of said wall for raising and lowering the height of the water ballast.

According to a second aspect of the present invention there is provided a method of adjusting the height of a structure floating on water, the structure comprising inflatable walls with one or more ports at or adjacent the foot of at least one of the walls, the method being characterised in that the height of the structure is lowered by admitting water through a port into the interior of the foot of the wall to form ballast, and the height of the structure is raised by allowing the internal air pressure within the wall to expel the water ballast.

According to a third aspect of the present invention, there is provided a floating structure with inflatable walls having means at or adjacent the foot thereof for receiving water ballast, the structure being for use in the method according to the first or second aspect, and the structure being characterised in that it comprises one or more ports at or adjacent the foot of at least one of the walls, the ports being arranged at substantially the same height and being connected to tubes of different length which extend downwardly towards or into the water ballast to define water ballast inlets at differing heights.

Preferred embodiments of the present invention will now be described, by way of example only, with reference to the accompanying drawings, of which:

Figure 1:
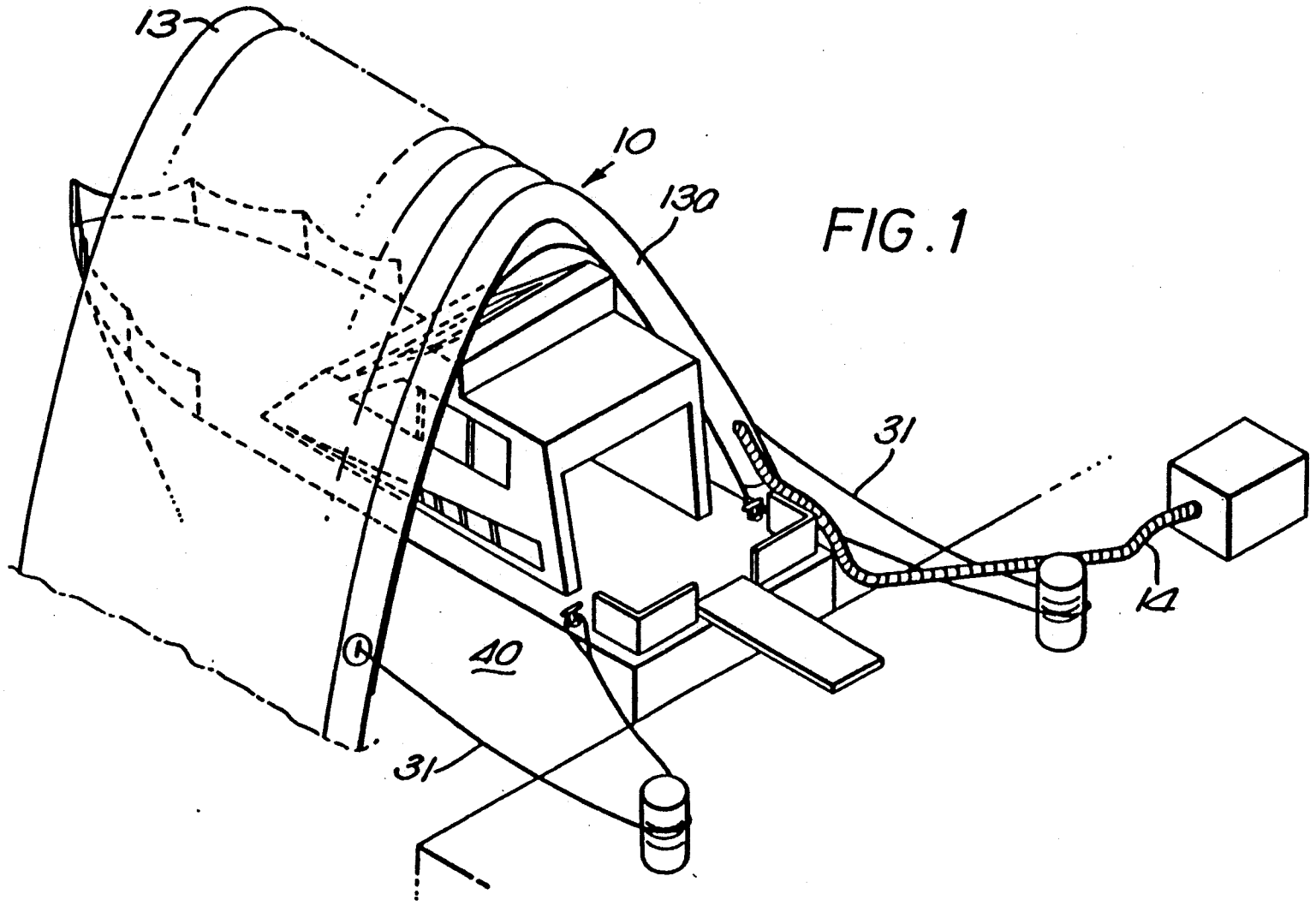
FIG. 1 shows a perspective view of an inflatable housing structure in accordance with a first embodiment of the present invention, used in connection with a boat.
Figure 2:
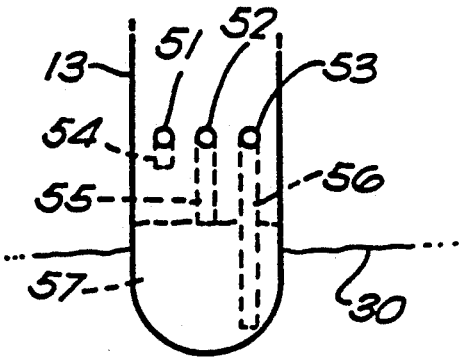
FIG. 2 is an enlarged end view of the foot of a wall of the structure of FIG. 1.
Figure 3:
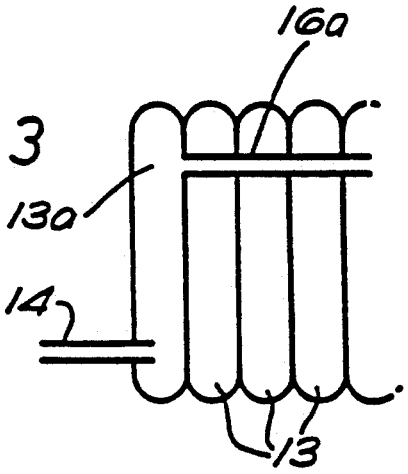
FIG. 3 is a schematic view showing how the wall of the structure is inflated with air.
Figure 4:
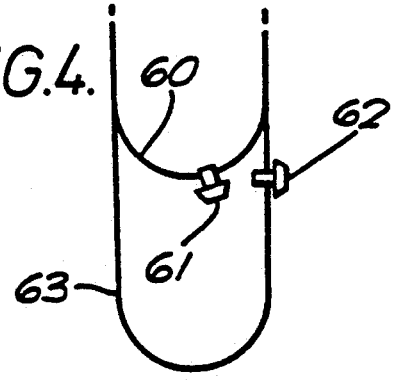
FIG. 4 is a view similar to FIG. 2 of a modification of the structure of FIGS. 1 to 3.

Referring to FIG. 1 there is shown a housing 10 with walls comprising a plurality of inflatable tubes 13 which are inflated via an airline 14 and maintained at an excess pressure over atmospheric pressure.

Both feet of the tubes are arranged to receive water 57 as ballast material by any of three closable ports 51,52,53. The ports communicate until respective tubes 54,55,56 which extend by differing amounts towards the foot of the wall, with the mouth of tube 56 being substantially at the foot itself.

The housing has tethers 31 which enable it to be secured to a harbour wall, as shown, or to an anchored vessel or other structure. In use these tethers react against horizontal forces applied to the housing, for example due to wind or tides.

Reaction against vertical forces when floating depends on whether there is a positive (downward) force or a negative (upward) force on the walls of the housing. Positive forces are resisted by the foot of the wall moving downwards to displace water and thus to provide a buoyancy force. Negative forces are reacted by the ballast 57 being lifted relative to the water surface to provide a restoring force. Of course, these two features work in parallel such that under normal conditions the displaced volume of water supports the total weight of the housing plus the part of the ballast water 57 which is stored above the water surface 30. When an external force causes the housing to lift on one side, less water is displaced by the housing and more water is lifted above the water line by the ballast tube. Both effects combine to provide a very strong restoring force.

The level of the water ballast can be raised by connecting a hose to any of ports 51,52,53 and turning on the water supply. The ports for the various tubes 13 may be separately accessible; alternatively, they may have a common manifold. If it is desired to lower the water ballast level, a selected one of the ports 51,52,53 (with its mouth below the current water ballast level) is simply opened to the atmosphere; in this case the excess air pressure within the inflatable wall is sufficient to expel the water until its level reaches the mouth of the tube. To completely remove the water ballast, port 53 and tube 56 are used; alternatively, or in addition, the tube may have a bung for this purpose.

The structure is of the air-inflated type rather than the air-supported type as disclosed in U.S. Pat. No. 4,004,380. Air from line 14 is supplied to a first of the tubes 13*a* from which it passes via a feed tube 16*a* and respective one-way valves to the other tubes 13. The use of end tube 13*a* as a reservoir prevents sudden fluctuations in pressure in the air supply system which can cause the pump to be continually stopping and restarting.

The housing has a wide range of applications: leisure, commercial, and military; it can be used as a boat cover, a building site cover, an emergency site or disaster cover or a repair site etc.

An advantage of the housing is that, when a vessel requires repair or maintenance, the housing can be brought to the vessel instead of vice versa. This means that a vessel of up to and above 70 meters in length no longer has to stay at a shipyard, creating inconvenience in dirty surroundings and extra costs and delays. Instead, by using a housing fitted out as a mobile workshop, the work can be carried out at the home port or other convenient site. The housing can easily be positioned around and subsequently removed from a vessel sitting at its mooring or at a berth, with no risk or damage to other vessels, since it has no metal or wooden parts.

Adjustment of the height of the water ballast material 57 can be simply undertaken by a relatively unskilled operator since the ports 51, 52, 53 are readily accessible at the foot of the wall and the process requires no complicated equipment or procedures. The ability to raise the level of water ballast reduces windage and improves the towability of the structure.

Many maintenance works are carried out, whilst at the quay, but weather, frost, dust or dew, can spoil a timetable or new paint job, creating extra cost and disturbance of the works involved, not to mention the noise or dirt factor which all too often is a cause of complaint from neighbouring vessels, Painting works undertaken in a normal shed, suffer from airborne dust created by movement disturbing particles upon the floor area. With housings according to the present invention the floor is wet, and the atmosphere cleaner, giving a better dust-free finish to a fine paint job.

As this is a temporary, removable structure, special building permits are not required and the location of the works can be chosen for preference.

Although primarily for use on water, the housing can also be used on land or dry dock since it has sufficient weight and stiffness. Tethering to the ground is usually also necessary. Thus quick soft temporary cover may be provided ashore for small vessels or for other special applications.

For use in dry dock, the water ballast is drained the housing is lifted into position by a crane, and the ballast then refilled. Should the dry dock be wider than required, a simple staging can be erected by scaffolding to accommodate the base of the housing 10.

Various modifications can be made to the above-described arrangement. For example tubes 13 may be individually inflatable if desired; alternatively they can be replaced by a single inflatable member defining the entire structure; however such a structure is not quite as stable and a serious air leak can not be isolated as with tubes 13. Any desired number of ports from one upwards can be used to adjust the water ballast level and separate inlet and outlet ports may be employed. Instead of having tubes 54, 55, 56 the ports 51,52,53 may simply be arranged at different heights.

Figure 5:
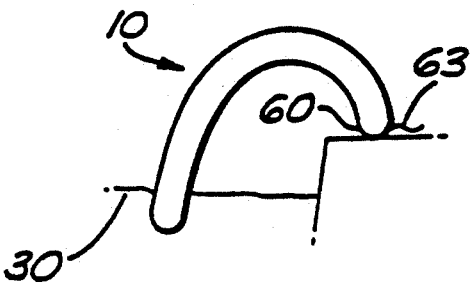
FIG. 5 is a sketch on a reduced scale, illustrating the use of the modification of FIG. 4.

In certain quayside applications it is desirable to have one edge of the housing floating in water and the other edge on land, see FIG. 5. To assist in this, one or both edges may be provided with an internal air-tight wall 60 spaced from the foot of the wall. Wall 60 incorporates a bung 61 and the adjacent external tube wall also has a bung 62. For use on land, the edge is collapsed by removing bung 62 and inserting bung 61, so that end 63 lies flat on the quayside.

Not all tubes 13 need to be provided with an adjustable water ballast level.

Figure 7:
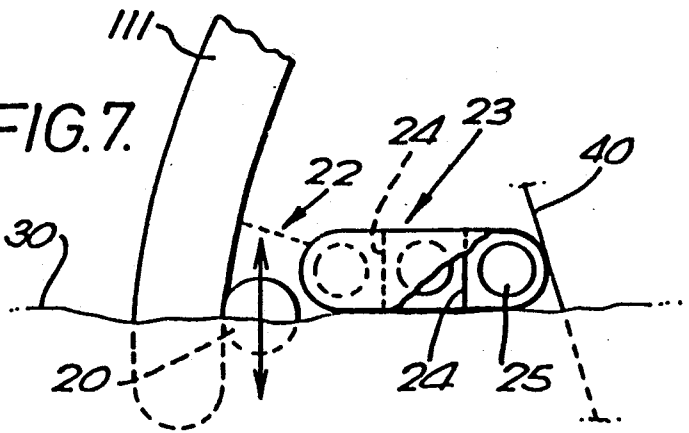
FIG. 7 is a partial cross-section through the base of one of the side walls of the structure of FIG. 6.
Figure 6:
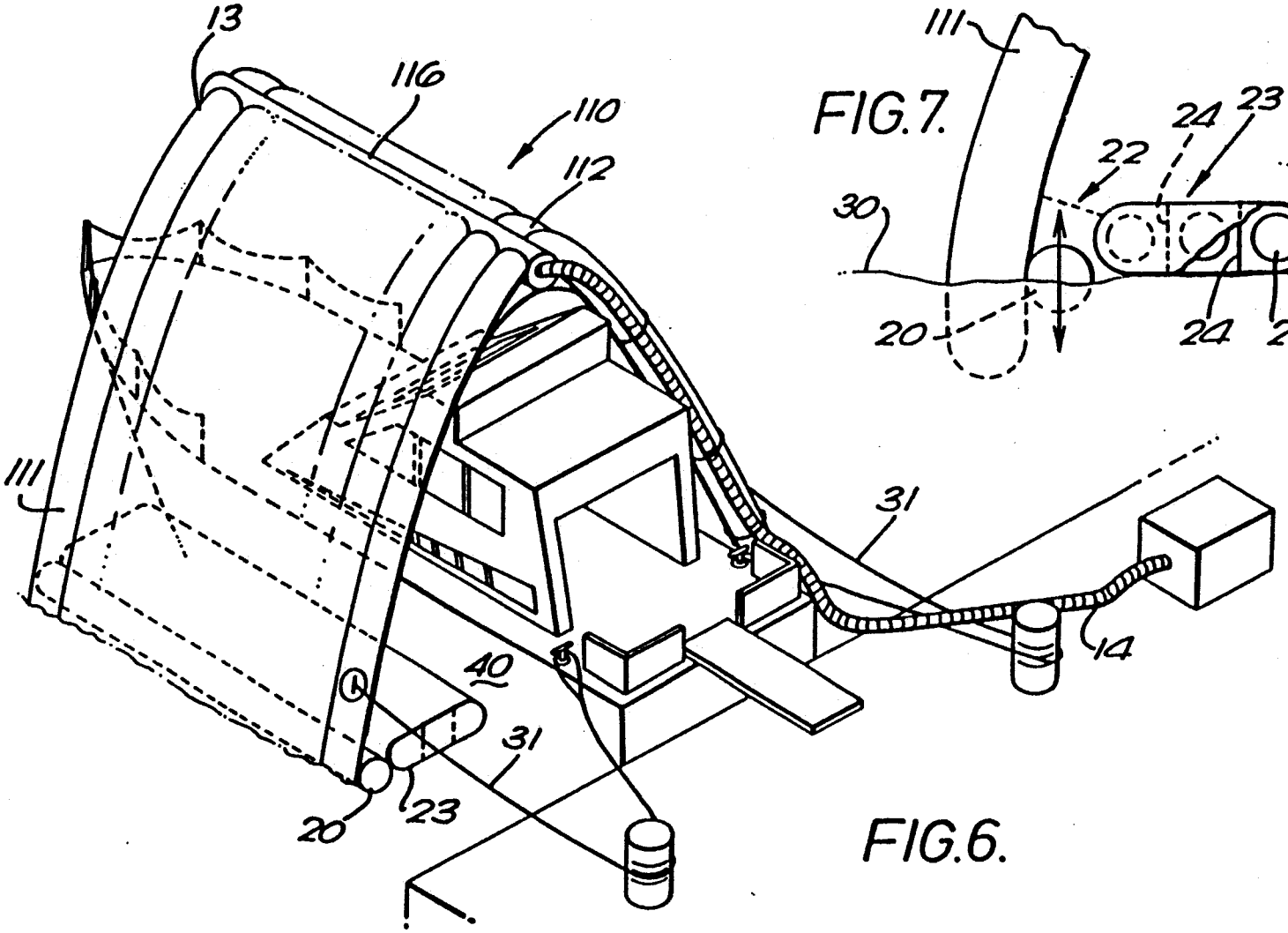
FIG. 6 shows a perspective view of a housing structure in accordance with a second embodiment of the present invention.

In a second embodiment, FIGS. 6 and 7 a housing 10 comprises two side walls 11,12, which meet at the top to form an arch. Each wall comprises a plurality of inflatable tubes 13, which are inflated via airline 14 and a top central feed tube 116 which is part of the housing structure. Transfer valves connect the air to enter the individual side wall tubes.

The housing 110 further comprises a ballast tube 20 at the foot of each side wall, the tube being arranged to be filled with water and being adjustable in height on the respective side wall. Alternatively, or in addition, the level of water within tube 20 may be adjusted as in the first embodiment.

Furthermore, secured to the side wall by a securing line 22 is a water jacket 23 which serves as an internal float or fender. The jacket is internally webbed to produce cell walls 24, and each cell has an air-filled tube 25, to serve as an aid to floating. The positions of ballast tube 20 and jacket 23 to the waterline 30 are shown in FIG. 7, which also shows the side of a boat 40 housed within the structure.

The above-described arrangement has the same advantages as the housing structure of FIGS. 1 to 4. In addition the vessel 40 upon which work is to be performed is protected from damage due to movements of the housing 110 because the contacting walls of float or jacket 23 are soft. Also, separate tubes 20 provide substantial lateral stiffness at the water surface.

Various further modifications may be made to both the above described arrangements. For example, the housing may be constructed in two sections; this is convenient where a vessel to be covered has a high mast in which case the two sections are introduced from the ends and then joined. The housing may be of any suitable modular construction to facilitate transport and to enable a housing to be provided for any size of vessel. Doors may be provided at its ends, and suitable ventilation regions may be provided to obtain a desired internal environment. The materials used should be lightweight, and preferably translucent and heat reflective.

The internal float 23 may be integral with its respective side wall and/or the adjacent ballast tube 20. In one modification the water ballast tube is arranged integrally beneath the float 23. Matting may be provided on the upper surface of float 23.

At low temperatures, the ballast water may be circulated and warmed by an auxiliary tank/pump unit; this helps to maintain a convenient internal environment.

A ballast material other than water may be used if desired.

The housing may be of any suitable cross-section, for example semi-circular, triangular, square, rectangular, or polygonal.

A structure employing the principles of the present invention may be used to form a pier structure or a boom for containing spilt oil.

I claim:

1. A floating structure with inflatable walls having means adjacent a foot thereof for receiving water ballast said means comprise a plurality of ports adjacent the foot of at least one of the walls with the ports being arranged at substantially the same height and being connected to tubes of different lengths which extend downwardly along inside the boot of the at least one of the walls to define water ballast inlets at differing heights.

2. A floating structure with an inflatable wall having means adjacent a foot thereof for receiving water ballast and an inflatable tube for floating on the water surface extending horizontally along the foot of said wall; the tube being at least partly filled with water ballast and the tube having a position being adjustable relative to the wall; and adjacent to the base of the wall there is arranged a float member in the form of a jacket which has internal webbing to produce cell walls forming air-filled tubes therebetween.

3. A floating structure with inflatable walls having means adjacent a foot thereof for receiving water ballast wherein said means comprise a plurality of ports adjacent the foot of at least one of the walls with the ports being arranged at substantially the same height and being connected to tubes of different length which extend downwardly along inside the foot of the at least one of the walls to define water ballast inlets at differing heights and wherein an edge of at least one of the walls is collapsible and has an auxiliary wall thereabove.

* * * * *